US005265701A

United States Patent [19]

Ogasawara et al.

[11] Patent Number: 5,265,701

[45] Date of Patent: Nov. 30, 1993

[54] ELEVATOR WITH MEANS FOR CONTROLLING UPWARD AND DOWNWARD MOVEMENT OF CAGE

[75] Inventors: Tsuyoshi Ogasawara, Ishioka; Ichiro Nakamura, Katsuta; Haruo Watanabe, Ibaraki; Masayuki Shigeta; Masakatsu Tanaka, both of Katsuta, all of Japan

[73] Assignee: Hitachi, Ltd., Tokyo, Japan

[21] Appl. No.: 848,134

[22] Filed: Mar. 9, 1992

[30] Foreign Application Priority Data

Mar. 20, 1991 [JP] Japan ..... 3-056341

[51] Int. Cl.[5] ..... B66B 1/24

[52] U.S. Cl. ..... 187/38; 187/68; 187/73; 188/170

[58] Field of Search ..... 187/38, 29.2, 68, 69, 187/70, 73; 188/170

[56] References Cited

U.S. PATENT DOCUMENTS

| | | | |
|---|---|---|---|
| 3,276,551 | 10/1966 | Buletti et al. | 188/170 X |
| 3,842,943 | 10/1974 | Nakamura et al. | 187/38 X |
| 4,337,926 | 7/1982 | Dehaan | 187/170 X |

FOREIGN PATENT DOCUMENTS

| | | |
|---|---|---|
| 661689 | 9/1963 | Canada . |
| 1959025 | 6/1970 | Fed. Rep. of Germany . |
| 134631 | 3/1979 | German Democratic Rep. . |
| 54-146361 | 11/1979 | Japan . |
| 899449 | 1/1982 | U.S.S.R. . |

OTHER PUBLICATIONS

Japanese Patent Unexamined Publication No. 60-148879.

International Publication No. WO 86/03184 (Japanese National Publication No. 62-500864).

*Primary Examiner*—Robert P. Olszewski

*Assistant Examiner*—Dean A. Reichard

*Attorney, Agent, or Firm*—Antonelli, Terry, Stout & Kraus

[57] ABSTRACT

In an elevator, for controlling the upward and downward movement of a cage, a shoe is brought into and out of pressing contact with a drum or a disk of a brake by a combination of a spring and a hydraulic cylinder. The optimum braking force is determined in accordance with the inertial mass and the speed of the cage to be braked, and the fluid pressure is controlled to control the force of pressing of the shoe against the drum or the disk, so that the brake can always produce the optimum braking force. A controller for controlling the pressure of the hydraulic cylinder is operated by an emergency power source. The brake can be controlled with a high responsibility and its braking force can be controlled arbitrarily, and even in the event of a power failure, the brake can be operated by the emergency power source of a small-capacity. Therefore, in the normal condition, the cage can be held accurately in its stop position, and in the event of an emergency, the optimum braking force is produced in accordance with the load and the speed of the cage, and the shortest braking distance can be achieved with a small braking impact.

25 Claims, 12 Drawing Sheets

ELEVATOR WITH MEANS FOR CONTROLLING UPWARD AND DOWNWARD MOVEMENT OF CAGE

BACKGROUND OF THE INVENTION

The present invention relates to an elevator of the type in which a cage is moved upward and downward by a hoisting device.

An elevator of this type is provided with a brake which holds a cage in its stop position when the cage is stopped, and safely brakes and stops the cage in the event of an emergency such as a power failure during the travel of the cage. This brake includes shoes which are pressed against a drum under a constant force by a mechanical means, such as a spring, and a frictional force produced at this time brakes or holds the cage. Generally, the frictional force of the brake is the product of the friction coefficient and the pressing force, and the friction coefficient is non-linear and is a function of the sliding speed and the pressing force. Therefore, in order to make the friction coefficient stable, it is required to select a suitable combination of the materials for the drum and the shoe, the optimum pressing pressure, etc. For running the elevator, this pressing force is electrically released, and the cage is driven by a motor or the like.

Such conventional devices are disclosed, for example, in International Publication WO86/03184 and Japanese Patent Unexamined Publication No. 60-148879.

When the elevator is designed to travel at high speed, the range of the sliding speed is widened, and the frictional force of the brake varies substantially according to the conventional method. Namely, with the conventional structure which merely applies the pressing force of a constant level mechanically, variations in the frictional force becomes large due to the wide range of the sliding speed, so that it is difficult to achieve a stable braking even if the combination of the materials of the element is suitably selected. Therefore, the braking acceleration is varied, so that the braking distance is increased, or in contrast a large braking shock is produced. Particularly in the type of structure in which the cage is driven by a sheave through a rope, if the braking force is too large, a slip develops between the rope and the sheave, so that the cage may fail to be braked effectively. The slip between the rope and the sheave also shortens the lifetime of the rope.

As the stroke of travel of the cage becomes long, the weight of the rope and other associated parts increases. Therefore, an unbalanced weight becomes smaller relatively but then the inertial mass to be braked becomes large. Therefore, even though the force required for holding the cage in its stop position is small, a large braking force is required. Namely, the braking force becomes much larger than the force for holding the cage in the stop position. Therefore, when it is intended to produce such a relatively large braking force by a mechanical means such as a spring, the size of the device becomes large.

SUMMARY OF THE INVENTION

It is an object of the present invention to provide an elevator in which a braking force of a brake is made stable by a small-size device over an entire range of speed of travel of a cage from high speed to low speed, thereby achieving a safe operation of the elevator.

To this end, according to one aspect of the present invention, there is provided an elevator which comprises a cage, driving means for moving the cage upward and downward through rope means, and means for braking the upward and downward movement of the cage, by means of a spring force and a fluid force.

According to another aspect of the invention, there is provided an elevator which comprises a cage, driving means for moving the cage upward and downward through rope means, mean for braking the upward and downward movement of the cage by means of a hydraulic cylinder, means for detecting at least one of the load and the speed of the cage, means for determining the braking force in accordance with the detection signal from the detection means, and means for controlling the pressure of the hydraulic cylinder in accordance with the braking force determined by the determining means.

According to a further aspect of the invention, there is provided an elevator which comprises a cage, driving means for moving the cage upward and downward through rope means, and means for braking the upward and downward movement of the cage, a braking force of the brake means being applied by a combination of a spring and a hydraulic cylinder, and the braking force being released by controlling the pressure of the hydraulic cylinder.

According to the present invention, in the normal condition, the cage is held by mechanical means, and further by utilizing the hydraulic cylinder hydraulic pressure is used to ensure the holding of the cage. In the event of an emergency, the braking force is optimized for the inertial mass to be braked and its speed, and therefore the cage can be safely stopped with a small braking impact and with the shortest braking distance. Further, a slip between a sheave and a rope can be prevented, and therefore damage to the rope can be reduced.

DETAILED DESCRIPTION OF THE PREFERRED EMBODIMENTS

Figure 1:
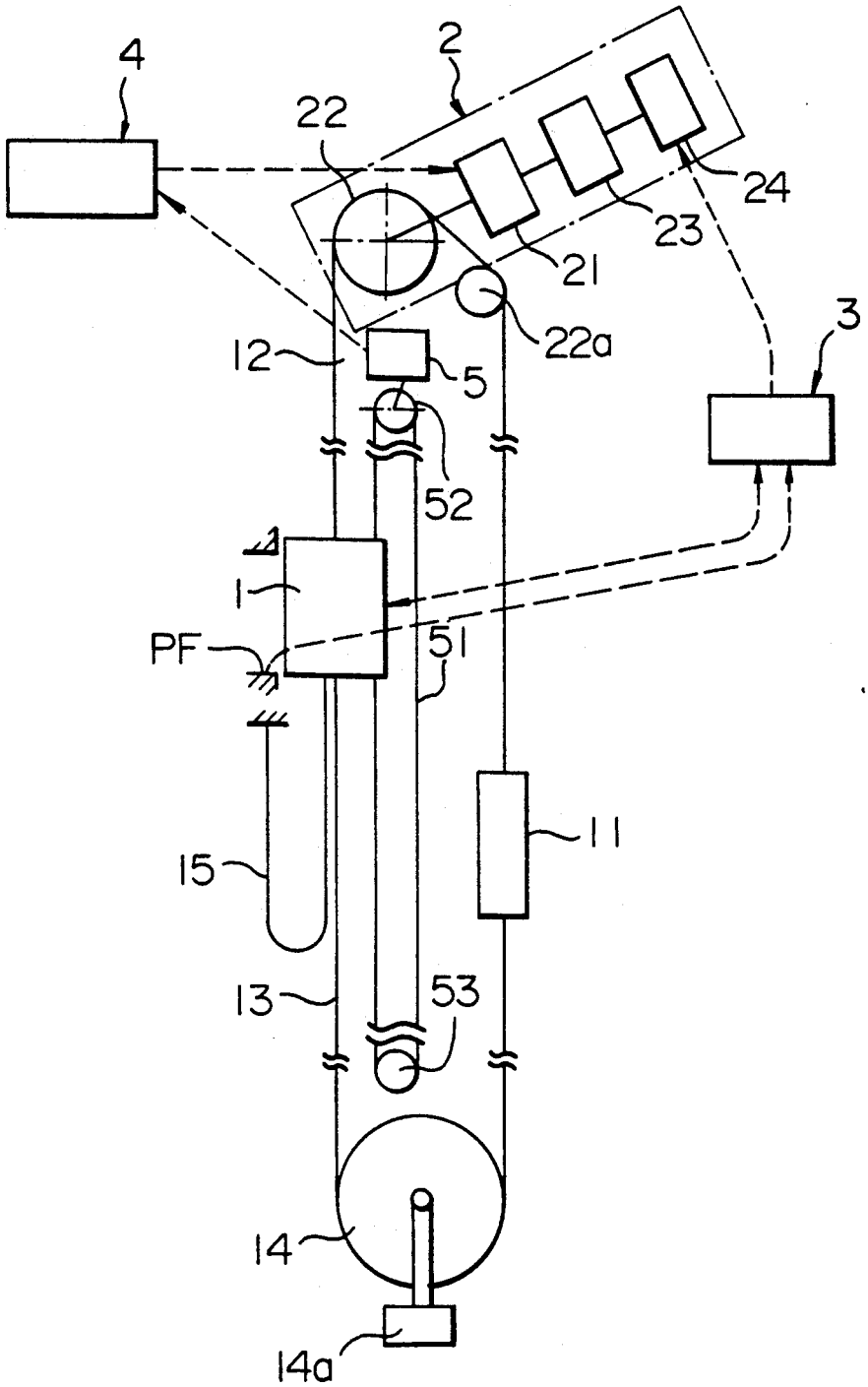
FIG. 1 is a view showing an elevator according to one embodiment of the present invention.
Figure 2:
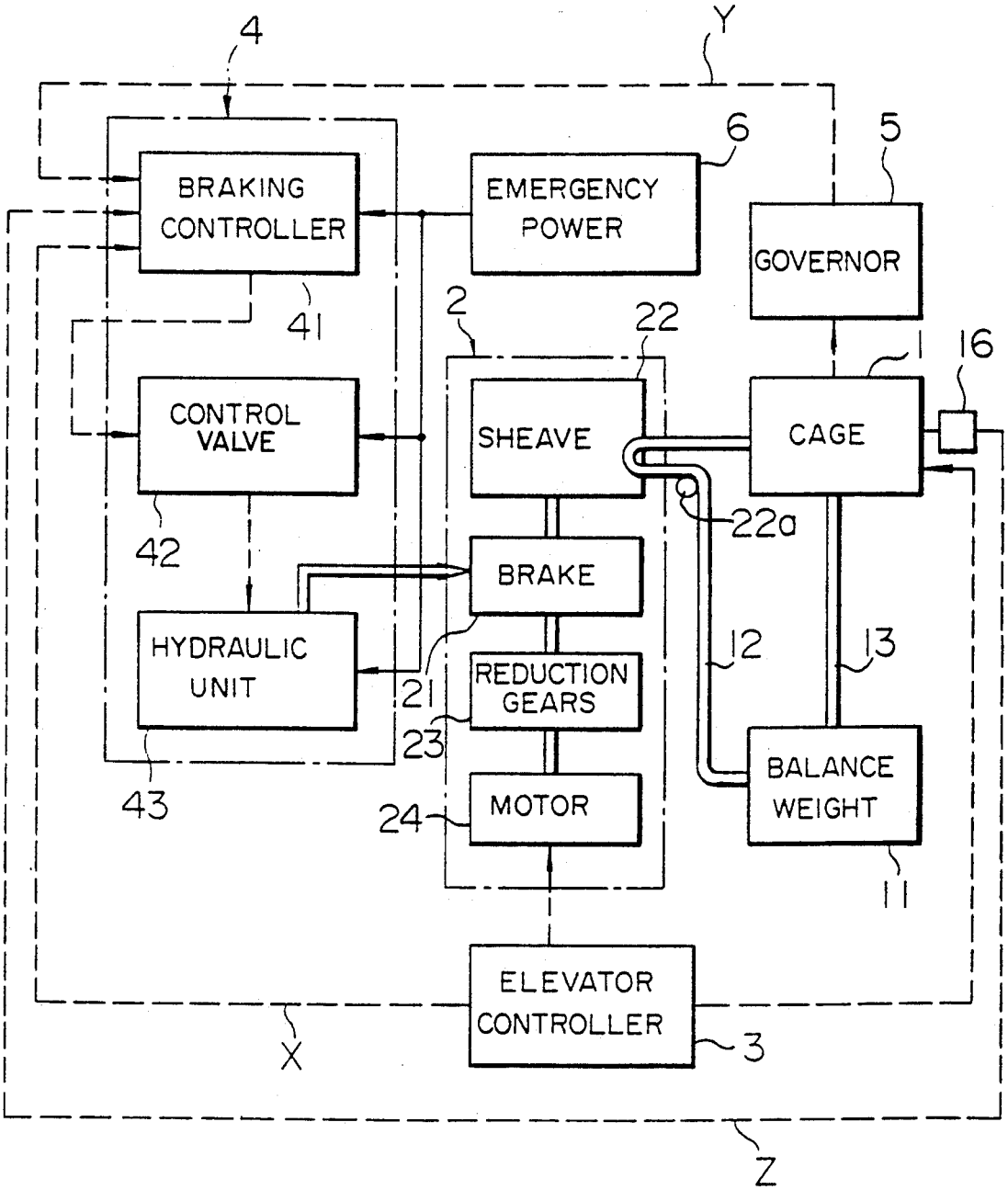
FIG. 2 is a block diagram showing the elevator of FIG. 1.

Referring to FIGS. 1 and 2, an elevator according to one embodiment of the present invention comprises a cage 1, a device 2 for driving the cage 1, an elevator controller 3, and a controller 4 for a brake 21. The cage 1 and a balance weight 11 are interconnected by a main rope 12 extending around a sheave 22 and a deflector wheel 22*a*, and also they are interconnected by a compensator rope 13 extending around a compensator pulley 14. Necessary electricity and signals are supplied to the cage 1 through a tail cord 15. The compensator pulley 14 and a weight 14*a* attached thereto impart an appropriate tension to the main rope 12 to prevent a slip between the sheave 22 and the rope 12. A governor 5 is driven by a governor rope 51 extending through governor pulleys 52 and 53 to the cage 1. The governor 5 detects the speed of the cage 1 and particularly an abnormal speed thereof, and sends an abnormal speed signal to a braking controller 41. The drive device 2 comprises the brake 21, the sheave 22, reduction gears 23, a motor 24. The rotation of the motor 24 is reduced by the reduction gears 23, and then is transmitted to the sheave 22 to drive the cage 1 and the balance weight 11 via the main rope 12. The brake 21 holds the cage 1 in its stop position when the cage 1 is stopped, and also brakes the cage 1 in the event of an emergency. In this embodiment, although the reduction gears 23 are used, the sheave 22 may be driven directly by a low-speed motor, instead. The elevator controller 3 manages and controls the driving device 2 in accordance with a calling signal from each floor (platform) PF and a destination signal from the cage 1, and the display of guidance signs at the platform and the cage 1, and the operation of a plurality of elevators. In accordance with a command X from the elevator controller 3, a signal Y from the governor 5 and a signal Z from a detection means 16 which detects, for example, the inertial mass and speed of the cage 1, the braking controller 41 calculates the braking force optimal for the operating condition at that time, and converts it into a pressure braking force of a hydraulic cylinder of the brake 21. The braking controller 41 controls a control valve 42 so as to control a pressure from a hydraulic unit 43 to be supplied to the hydraulic cylinder of the brake 21 so as to control the pressure (braking force). Even in the event of a power failure or the like, an emergency power source 6 can supply power to the devices and the equipment, such as the braking controller, the control valve and the hydraulic unit which are required for maintaining the safety of the elevator.

Figure 3:
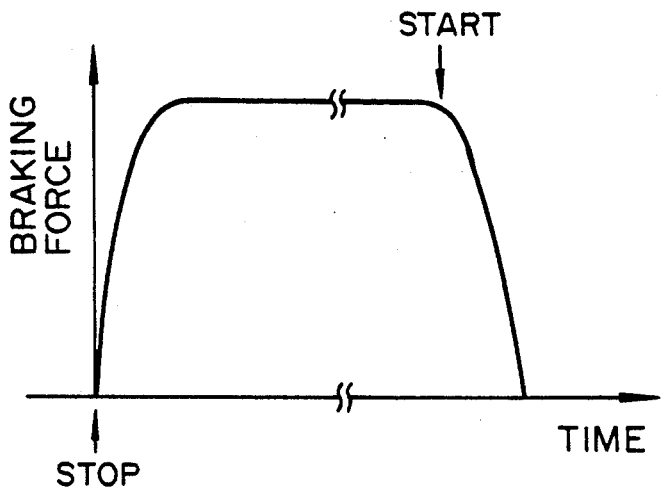
FIG. 3 is a diagram showing an operation of a brake in a normal condition.
Figure 4:
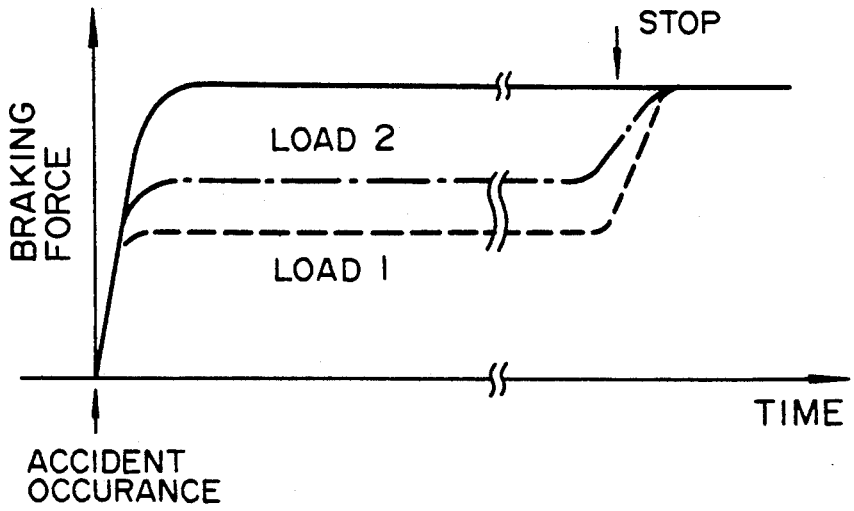
FIG. 4 is a diagram showing an operation of the brake at an emergency.

In the normal operation of the elevator, as shown in FIG. 3, the brake 21 applies the braking force when the elevator is stopped, and releases it before the elevator is started, and the speed control of the cage 1 is completely effected by the motor 24. During the operation of the elevator (that is, during the release of the brake 21), when an accident occurs (for example, if the cage 1 runs at a speed higher than the rated speed, so that the governor 5 detects an abnormal speed, or if the motor 24 fails to work as a result of a power failure), the braking controller 41 operates the control valve 42 to stop the elevator without delay. At this time, the optimum braking force is calculated in accordance with the load condition (the magnitude of the total inertial mass) and the travel speed so that the braking impact of the cage 1 may not become excessive and so that a slip may not develop between the rope 12 and the sheave 22, and the brake 21 is controlled in accordance with this optimum braking force. Therefore, as shown in FIG. 4, the braking force, which is optimum for the respective load conditions, is rapidly produced upon occurrence of the accident so as to decelerate and stop the cage 1, and there is produced a braking force capable of positively holding the cage 1 in its stop position after the cage 1 is stopped. Namely, the braking force varies according to the operation conditions. When the load is large on the descent of the cage 1, the braking force varies as indicated by a solid line. When the load is small on the climb of the cage 1 (LOAD 1), the braking force varies as indicated by a broken line. To the contrary, when the load is large on the climb of the cage 1 (LOAD 2), the braking force varies as indicated by the chain line in FIG. 4.

Figure 5:
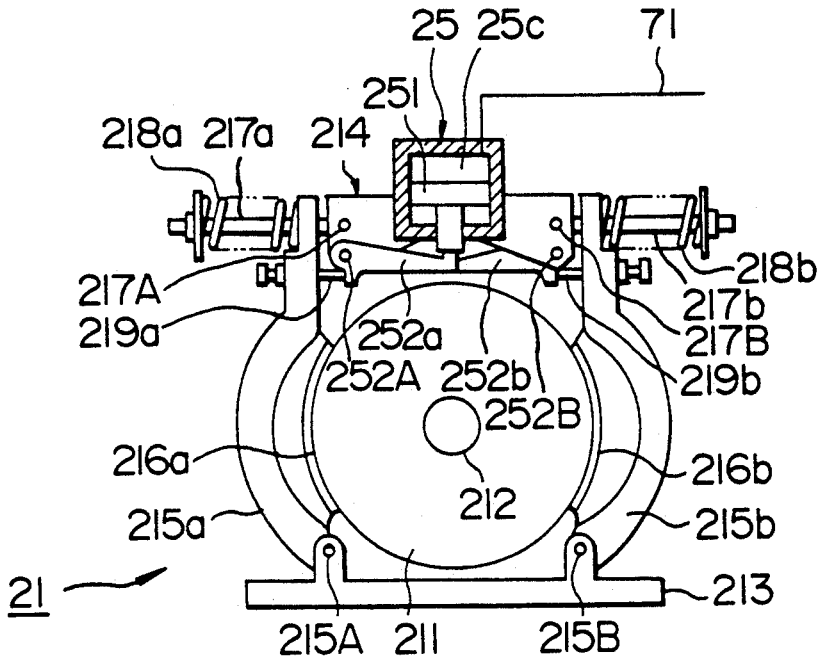
FIG. 5 is a view of the brake in the embodiment of FIG. 1.

In a brake 21 used in one embodiment of the present invention shown in FIG. 5, a drum 211 is fixedly mounted on a drive shaft 212, and is rotated in clockwise and counterclockwise directions in accordance with the upward and downward movements of the cage 1. A bed 213 and a stationary frame 214 are fixed onto a base (not shown) of the driving device 2 of the elevator. Arms 215*a* and 215*b* having the respective shoes 216*a* and 216*b* are pivotally mounted to the bed 213 through pins 215A and 215B, respectively. The arms 215*a* and 215*b* are urged toward the frame 214 by rods 217*a* and 217*b* and springs 218*a* and 218*b* to produce the braking force. The rods 217*a* and 217*b* are mounted to the frame 214 by pins 217A and 217B, respectively. The movement of a piston 251 of the hydraulic cylinder 25 is transmitted to the arms 215*a* and 215*b* through links 252*a* and 252*b*. The links 252*a* and 252*b* are mounted on the frame 214 by pins 252A and 252B, respectively. In order to ensure that the force of the piston 251 can be transmitted uniformly to the arms 215*a* and 215*b*, members 219*a* and 219*b* are provided for adjusting the gap between the links and the arms. Namely, the piston 251 overcomes the springs 218*a* and 218*b* to move the shoes 216*a* and 216*b* apart from the drum 211 to release the brake. By controlling the pressure of fluid supplied to a chamber 25*c* of the hydraulic cylinder 25 via a flow line 71, the output of the piston 251, that is, the force of pressing of the shoes 22 against the drum 211, can be controlled, thereby controlling the braking force.

In the normal condition of the elevator, when the cage 1 is stopped, the shoes 216*a* and 216*b* are pressed against the drum 211 by means of the springs 218*a* and 218*b* so as to generate the frictional force, which prevents the movement of the drive shaft 212. In accordance with commands for the elevator operation, the fluid of high pressure is supplied to the hydraulic cylinder 25 to push the piston 251 to overcome the forces of the springs thereby moving the piston, so that the shoes 216*a* and 216*b* are moved against the springs 218*a* and 218*b* apart from the drum 211 to release the brake. Thereafter, the motor 24 accelerates the cage 1 upward or downward, runs it and decelerates it. When the cage 1 is stopped, the high-pressure fluid is discharged from the chamber 25*c*, so that the springs 218*a* and 218*b* overcome the hydraulic force and then press the shoes 216*a* and 216*b* against the drum 211, thereby holding the cage 1. The braking force obtained at this time, namely the spring force, is so set as to be large enough to safely brake the cage 1 under any conditions as when the load is unbalanced or in the event of emergency braking.

When an accident occurs during the operation of the elevator (while the high-pressure fluid is supplied to the hydraulic cylinder 25 to keep the brake 21 released), the braking force required for the brake varies depending on the load as shown in FIG. 4, for example, whether the load is large or small, and depending on whether the cage 1 moves upward or downward. In accordance with the signals from the elevator controller 3 and the governor 5, the braking controller 41 determines the optimum braking force for the operating condition at that time, that is, the optimum pressure of the hydraulic cylinder 25. The braking controller 41 controls the pressure control valve 42 to discharge the high-pressure fluid from the hydraulic cylinder 25, so that the shoes 216*a* and 216*b* are pressed against the drum 211 under the influence of the springs 218*a* and 218*b*, thereby braking the cage 1 by the friction force produced between the shoes 216*a* and 216*b* and the drum 211. By doing so, a slip between the sheave 22 and the main rope 12 is prevented when applying the braking, and then the cage 1 can be braked and stopped with a small braking impact and also with the shortest braking distance.

The stroke of travel of the cage 1 becomes long in a multi-storied building having many floors. In this case, in order to enhance the transport efficiency, the capacity of the cage 1 is increased so as to accommodate an increased number of passengers, and also the cage 1 is designed to run at high speed. As a result, in addition to the increased load mass (the passengers), the inertial masses of the cage 1 and the balance weight 11 as well as the weight of the main rope 12 and the compensator rope 13 balanced with it are increased at a larger rate. Namely, the increase of the inertial mass becomes larger than the increase of the unbalance weight due to a change of the number of passengers. As a result, the braking force of the brake 21 required for braking the running inertial mass is relatively larger than the force of the brake 21 required for statically holding the cage 1. Therefore, if the braking force depends entirely on the pressing force of the springs 218*a* and 218*b*, these springs are increased in size and then the device is also increased in size, and the installation space is also increased.

Figure 6:
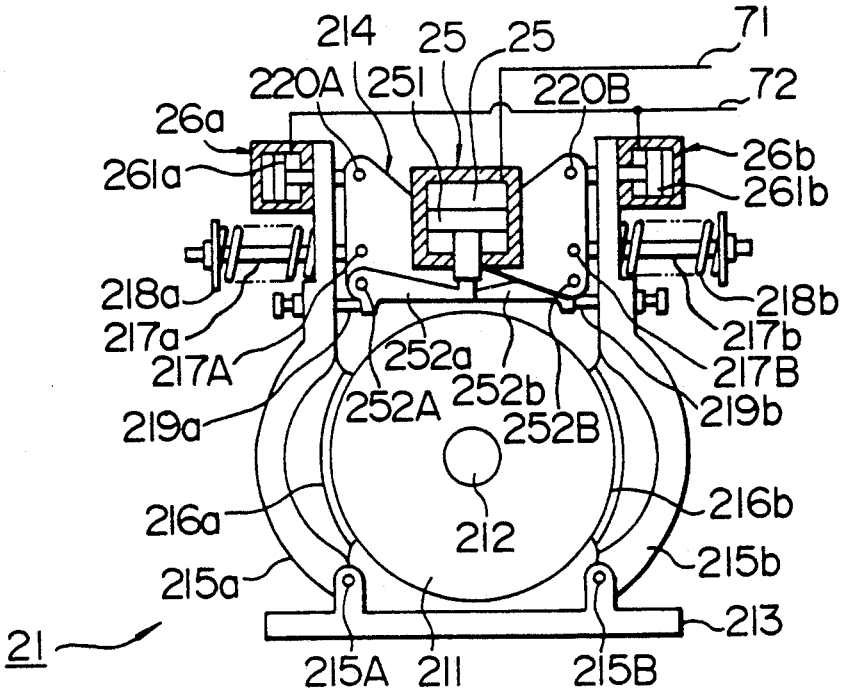
FIGS. 6 to 10 are views showing modified brakes, respectively.

FIG. 6 shows a modified brake in which forces for pressing shoes 216*a* and 216*b* against a drum 211 are produced by springs 218*a* and 218*b* and hydraulic cylinders 26*a* and 26*b*. The pressing forces are released by a hydraulic cylinder 25. The same reference numerals as those of FIG. 5 denote identical or corresponding parts, respectively. The hydraulic cylinders 26*a* and 26*b* are mounted respectively on arms 215*a* and 215*b* in parallel relation to the springs 218*a* and 218*b*, respectively, and are connected to a stationary frame 214 by respective pins 220A and 220B. A high-pressure fluid of a constant pressure is supplied via a flow line 72 to a rod-side fluid chamber of each of the hydraulic cylinders 26*a* and 26*b*, so that they press the arms 215*a* and 215*b* toward the drum 211 through their respective pistons 261*a* and 261*b*. At this time, the springs 218*a* and 218*b* have charge of only the force for holding the cage in the stop position, and the hydraulic cylinders 26*a* and 26*b* only produce the force obtained by subtracting the holding force of the springs 218*a* and 218*b* from the force required for braking the running cage. In case of the same outputs the hydraulic cylinder is smaller in size than the spring. Therefore the device can be of a compact size. Further, even if an accident should occur at the hydraulic system, the minimum braking force required for holding the cage can be provided by the springs 218*a* and 218*b*. If the pressure of the rod-side fluid chamber is controlled to a constant level, the output can also be made constant. The hydraulic cylinder 25 produces a force larger than the sum of the holding force of the springs 218*a* and 218*b* and the force of the hydraulic cylinders 26*a* and 26*b*. The control of braking force is conducted by the pressure in the chamber 25*c* of the hydraulic cylinder 25, thereby effecting the control in the same manner as described in the embodiment of FIG. 5.

Figure 7:
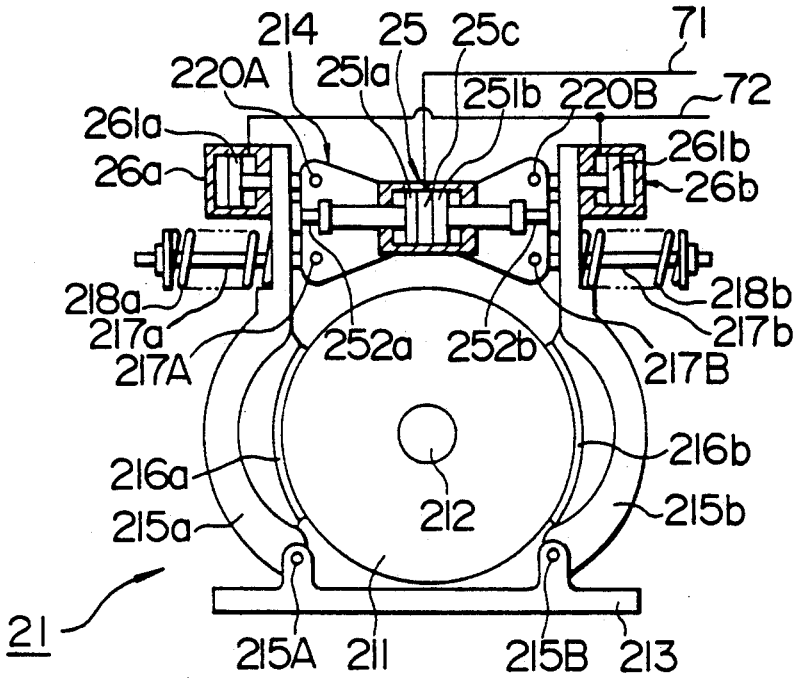

FIG. 7 shows another modified brake in which arms 215*a* and 215*b* are driven directly by a hydraulic cylinder 25 having two pistons. The same reference numerals as those of FIG. 6 denote identical or corresponding parts, respectively. The brake of FIG. 7 is generally similar to the brake of FIG. 6. Referring to differences therebetween, in the brake of FIG. 6, the hydraulic cylinder 25 has one piston 251, and the output thereof is transmitted to the arms 215*a* and 215*b* through the links 252*a* and 252*b* whereas in FIG. 7, the hydraulic cylinder 25 has two opposed pistons 251*a* and 251*b* between which a chamber 25*c* is interposed. A cylinder body of the cylinder 25 is fixed onto a stationary frame 214. Piston rods 253*a* and 253*b* are extended and retracted at the opposite sides to directly drive the arms 215*a* and 215*b*. The control of force for pressing shoes 216*a* and 216*b* against a drum 211 is conducted by a hydraulic pressure in the chamber 25*a*. Namely, when the pressure of the chamber 25*c* is high, the output of the hydraulic cylinder 25 is large, so that the shoe pressing force becomes small, thereby decreasing the braking force. In contrast, when the pressure of the chamber 25*c* is low, the braking force becomes large. Thus, the setting and release of the brake is the same as described for the brake of FIG. 6. As compared with the brake of FIG. 6, this brake does not require the links, and therefore is simplified in construction. However, the output of the hydraulic cylinder can not be amplified. The other structures and operation are similar to those of the brake of FIG. 6, and explanation thereof is omitted here.

Figure 8:
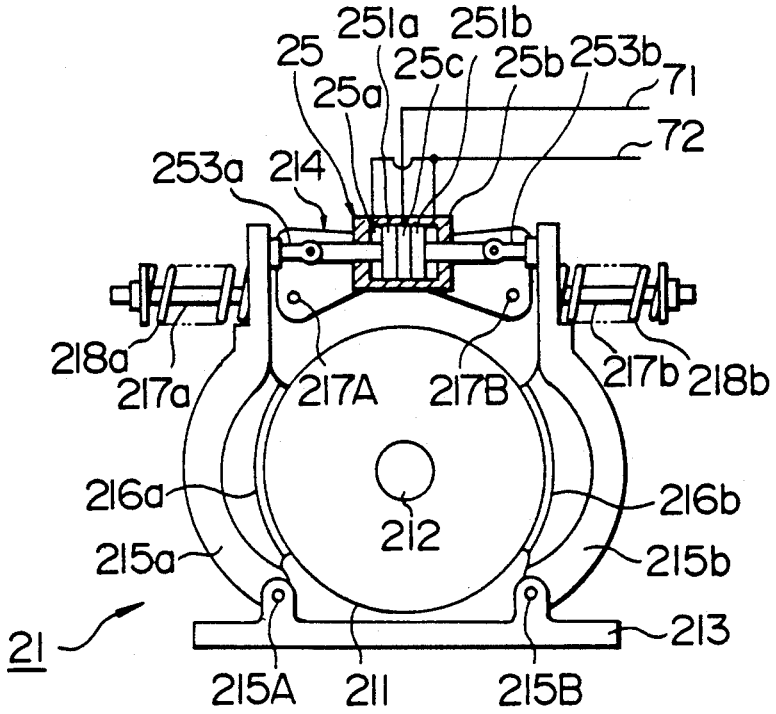

FIG. 8 shows a further modified brake in which force for pressing shoes 216*a* and 216*b* against a drum 211 is produced by springs 24 and a retracting action of a hydraulic cylinder 25. The shoe pressing force is released by an expanding action of the cylinder 25. Namely, the cylinders 26*a* and 26*b* for urging the shoes 216*a* and 216*b* and the cylinder 25 for releasing the brake in FIG. 7 are combined into the single hydraulic cylinder 25 in FIG. 8. The hydraulic cylinder 25 in FIG. 8 has two pistons 251*a* and 251*b*, and piston rods are connected respectively to the arms 215*a* and 215*b* through respective adjusting portions 253*a* and 253*b*. A cylinder body is fixed onto a stationary frame 214, and the pistons 251*a* and 251*b* are extended and retracted at the opposite sides to directly drive the arms 215*a* and 215*b*. A high-pressure fluid controlled in pressure is supplied to a center chamber 25*c* between the pistons 251*a* and 251*b* via a flow line 71, and a fluid pressure controlled to a constant pressure is supplied to piston rod side chambers 25*a* and 25*b* via a flow line 72. The hydraulic pressure is always imparted to the chambers 25*a* and 25*b* so as to urge the shoes 216*a* and 216*b* against the drum 20. The controlled fluid pressure is adapted to be imparted to the chamber 25*c* so as to release the shoe pressing force. Therefore, as the same as in the brake of FIG. 7, by controlling the pressure of the high-pressure fluid supplied to the chamber 25c, the braking force can be controlled. In this brake, the hydraulic cylinders 26a and 26b in FIG. 7 are not required, and therefore the brake 21 can be simplified in construction.

Figure 9:
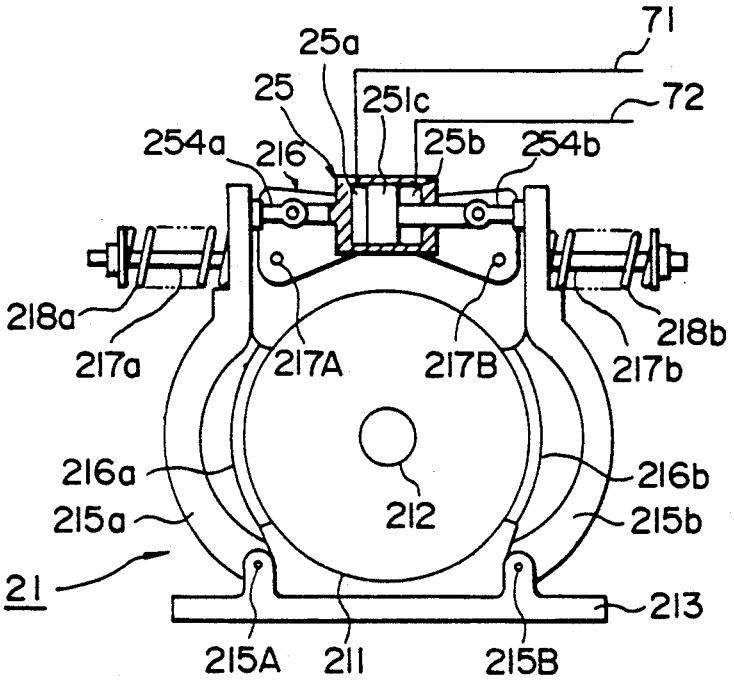

FIG. 9 shows a further modified brake in which shoes 216a and 216b are pressed against and moved away from a drum 211 by a single-rod cylinder 25. When a constant hydraulic pressure is imparted to a one chamber 25b, a piston 251c is moved to retract arms 215a and 215b to press shoes 216a and 216b against a drum 211 in cooperation with springs 218a and 218b. When a controlled fluid pressure is supplied to the other chamber 25a, the shoe pressing force is reduced. Therefore, as the same as in the brakes of FIGS. 6 to 8, the braking force can be controlled by controlling the pressure of the chambers 25a and 25b.

Figure 10:
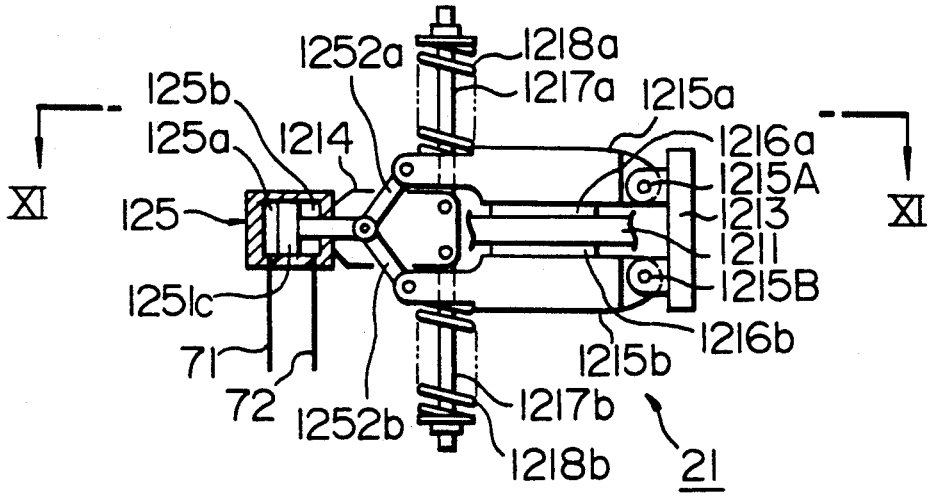
Figure 11:
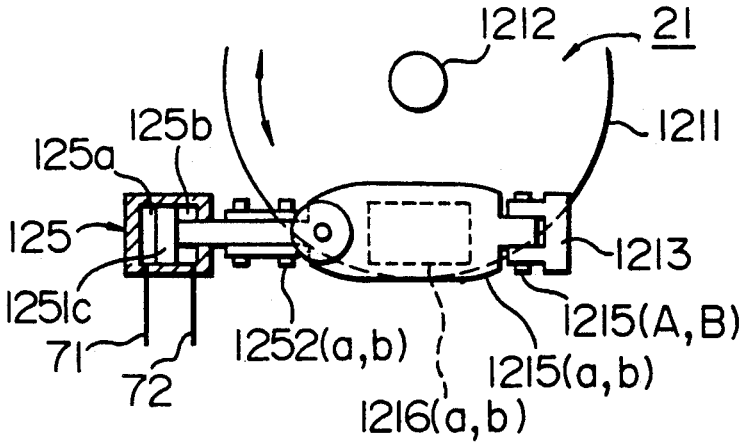
FIG. 11 is a view taken along the lines XI-XI in FIG. 10.

FIGS. 10 and 11 show a disk brake applied to another embodiment of the present invention. A disk 1211 is fixed to a drive shaft 1212, and is driven in a clockwise direction or a counterclockwise direction in accordance with the upward and downward movement of the cage 1. A brake bed 1213 and a stationary frame 1214 are fixedly mounted on a base (not shown) of a drive device of an elevator. Arms 1215a and 1215b each carrying respective shoes 1216a and 1216b are connected to the brake bed 1213 through pins 1215A and 1215B. The arms 1215a and 1215b are urged toward the stationary frame 1214 by springs 1218a and 1218b wound around rods 1217a and 1217b. Namely, the shoes 1216a and 1216b are pressed against the disk 1211 to produce a braking force. The movement of a piston 1251c of a hydraulic cylinder 125 is transmitted to the arms 1215a and 1215b via links 1252a and 1252b. The hydraulic cylinder 125 of a single-rod cylinder supplys a high-pressure fluid to a chamber 125b so as to press the shoes 1216a and 1216b against the disk 1211 in cooperation with the springs 1218a and 1218b, and supplys a high-pressure fluid to a chamber 125a so as to release this pressing force. Namely, the shoes 1216a and 1216b are pressed against the disk 1211 by the forces of the hydraulic cylinder 125 and the springs 1218a and 1218b to set the braking force. When the force of the hydraulic cylinder 125 overcomes the force of the springs 1218a and 1218b so as to move the shoes 1216a and 1216b apart from the disk 1211, the braking force is released. By controlling the hydraulic pressure supplied to the chamber 125a of the hydraulic cylinder 125 via a flow line 71, the output of the piston 1251c can be controlled, so that the braking force produced between the shoes 1216a and 1216b and the disk 1211 can also be controlled. In this brake, the disk lower in inertia than the drum is used, and therefore the force required for braking the disk can be decreased.

Figure 12:
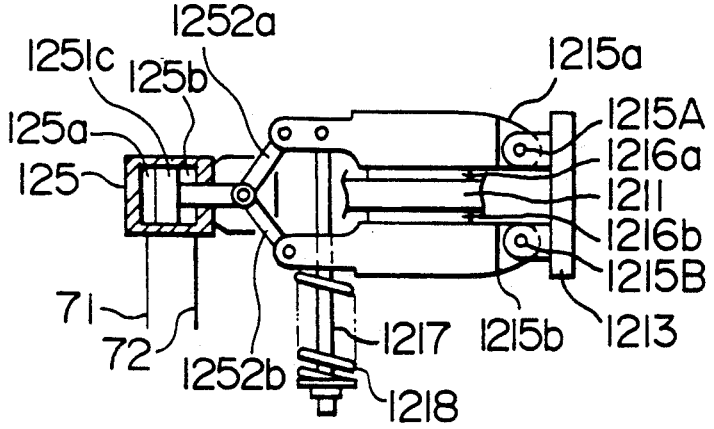
FIG. 12 is a view of a further modified brake.

FIG. 12 shows a modification of the embodiment of FIG. 10, in which a single spring replaces the two springs. More specifically, for pressing shoes 1216a and 1216b against a disk 1211, the arms 1215a and 1215b are urged toward the disk 1211 by the single spring 1218 as well as the hydraulic cylinder 125. For releasing the brake, the arms 1215a and 1215b are moved away from each other by the hydraulic cylinder 125 via links 1252a and 1252b. The operation and the control of the force are similar to those described in the brake of FIG. 10, and therefore explanation thereof is omitted here. In this brake, because of the use of the single spring 1218, the spring forces urging the respective arms are uniform, and then the adjustment is easy.

Figure 13:
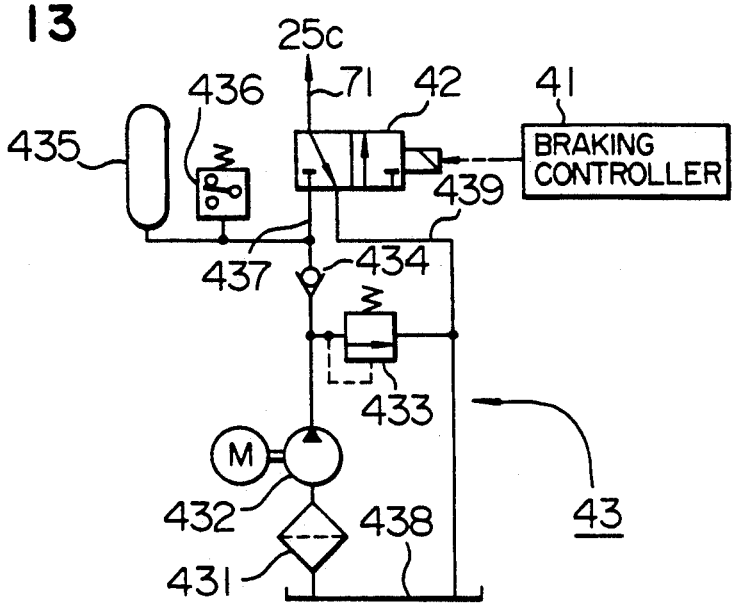
FIG. 13 is a circuit diagram of a hydraulic system for driving a hydraulic cylinder used in the embodiment of the invention.

FIG. 13 shows one example of the hydraulic unit 43 of the controller 4 shown in FIG. 2, which controls the pressure in the chamber 25c of the hydraulic cylinder 25 shown in FIG. 5. The hydraulic unit 43 comprises a filter 431, a motor driven hydraulic pump 432, a relief valve 433, a check valve 434, an accumulator 435, a pressure switch 436, and a fluid tank 438. A working fluid from a fluid tank 438 is pumped by the hydraulic pump 432, and is accumulated in the accumulator 435. At this time, the hydraulic pump 432 is operated or stopped by a signal from the pressure switch 436 to always keep the pressure of the fluid accumulated in the accumulator 435 to a generally constant level. The filter 431 removes foreign matters from the fluid. The relief valve 433 prevents the pressure at the outlet of the pressure pump 432 from becoming unduly high. The check valve 434 prevents the fluid from flowing in a reverse direction toward the pump 432 even when the pump 432 is stopped. A pressure control valve 42 is communicated with the chamber 25c of the hydraulic cylinder 25 through the line 71. It normally releases the fluid from the chamber 25c. In response to an instruction from the braking controller 41, the control valve 42 is switched over to supply the high-pressure fluid from the accumulator 435 to the chamber 25c of the hydraulic cylinder 25 so as to control the pressure in the chamber 25c.

Namely, in a normal operation of the elevator, in accordance with the instruction from the braking controller 41, the high-pressure fluid is supplied from the accumulator 435 to the chamber 25c to release the brake. To the contrary, when the cage 1 is stopped, the high-pressure fluid is discharged from the chamber 25c to set the brake. At this time, in order to effect the release and setting of the brake rapidly, the flow rate is required to be large. When an accident, such as a power failure, occurs during the travel of the elevator, the braking controller 41 calculates the optimum braking force (that is, the force of pressing of the shoes 216a and 216b against the drum 211) in view of the magnitude of the inertial mass and the travel speed at that time. It converts this force into the decreased pressure of the hydraulic cylinder 25, and sends instructions to the pressure control valve 42. In response to the instructions from the braking controller 41, the pressure control valve 42 is switched over to allow the high-pressure fluid to be discharge from the chamber 25c to set the brake. At this time, since the capacity of the chamber 25a is small, the pressure of the chamber 25c greatly decreases even when a small amount of the fluid is discharged from the chamber 25c. Therefore, the control valve 42 effects the pressure control between the high pressure in the accumulator 435 and the low pressure in the tank 438. By doing so, the braking force can be controlled in the above-mentioned manner. Thus, the control valve 42 is required to effect both the flow rate control in the normal operation and the pressure control in the emergent.

Figure 14:
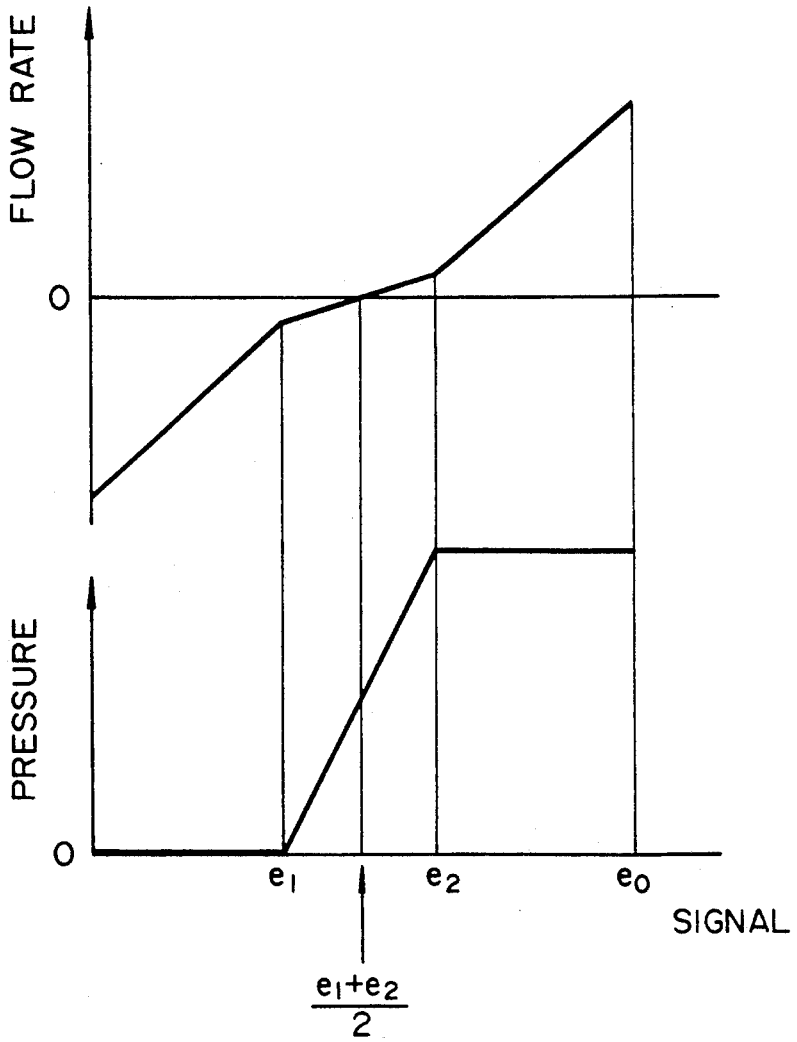
FIG. 14 is a diagram explanatory of characteristics of a control valve.
Figure 15A:
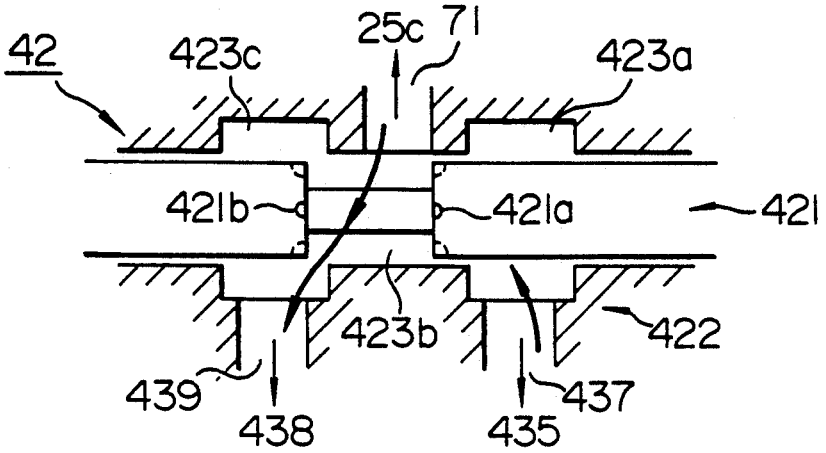
FIGS. 15A to 15C are views showing the operation of the control portion of the control valve.
Figure 15B:
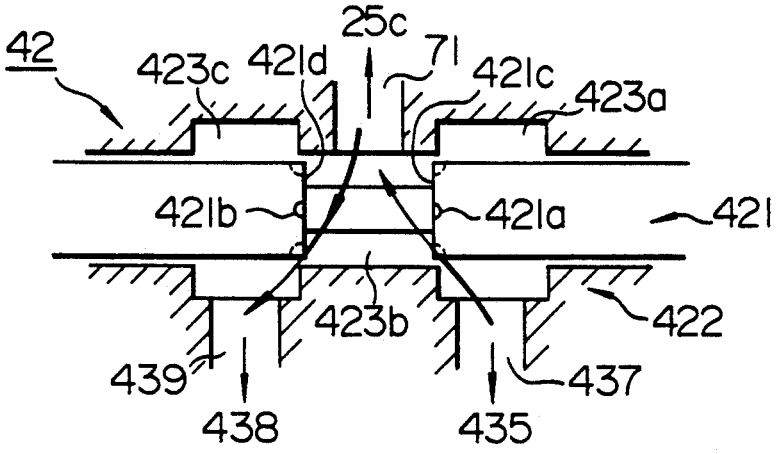
Figure 15C:
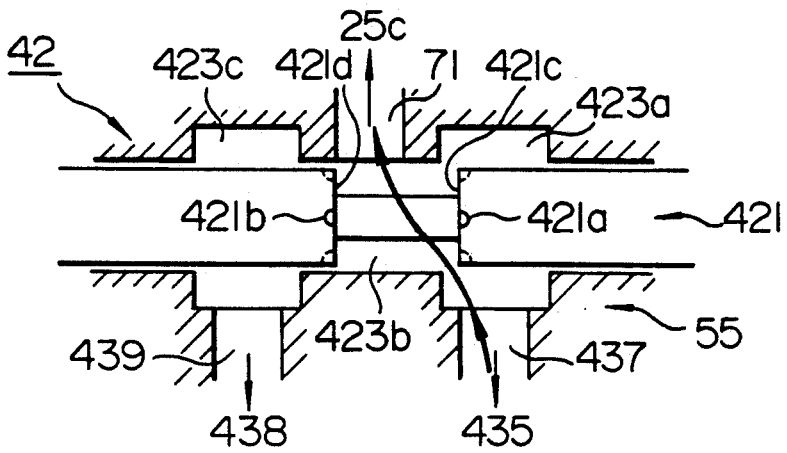

FIG. 14 shows characteristics of the flow control valve 42. The abscissa axis represents a magnitude of instruction signal, and the ordinate axis represents the controlled flow rate of fluid flowing through the control valve 42 and the pressure. The positive flow rate represents a flow rate of fluid flowing from the accumulator to the cylinder chamber. To the contrary, the negative flow rate represents a flow rate of fluid flowing from the cylinder chamber to the tank. When the instruction signal is "0", the chamber of the hydraulic cylinder is fully communicated with the tank, or both flow rate and pressure are zero. When the instruction signal is the rated value "$e_0$", the accumulator is fully communicated with the chamber of the hydraulic cylinder. The "$e_1$" and "$e_2$" which are smaller than "$e_0$" are so set that "$e_1$" is smaller than "$e_2$". The range of between "0" and "$e_1$" and the range of between "$e_2$" to "$e_0$" define the flow rate control ranges, and the range of between "$e_1$" and "$e_2$" defines the pressure control range. One example of the construction of the control portion of the control valve 42 is shown in FIGS. 15A–15C. The control valve 42 includes a sleeve 422, and a spool 421 having notches 421*a* and 421*b* formed on land portions and a sleeve 422 within which the spool moves axially. They define therebetween chambers 423*a*, 423*b* and 423*c* which are communicated respectively with a high-pressure flow passage 437, the flow line 71 leading to the cylinder 25, and a flow passage 439 leading to the tank 438. So long as a sufficient responsibility can be obtained when controlling the flow rate and the pressure, the spool 421 may be driven by any one of mechanical, electrical, electromagnetic and hydraulic means. FIG. 15A shows the position of the spool when the instruction signal is "0", and FIG. 15B shows the spool position when the instruction signal is $(e_1+e_2)/2$, and FIG. 15C shoes the spool position when the instruction signal is "$e_0$". When the instruction signal is "0" (FIG. 15A), the flow line 71 (cylinder port) is communicated with the low-pressure flow passage 439 (tank port), so that the chamber 25*c* of the cylinder 25 is open to the low pressure. As the instruction signal becomes larger, the spool 421 moves right in the drawings, so that the area of opening between the chambers 423*b* and 423*c* is decreased to make the flow rate small. When the instruction signal becomes "$e_1$", an end surface 421*d* of a left spool land partially closes the passage between the chambers 423*b* and 423*c*, but these chambers are slightly communicated with each other via the notch 421*b*. The notch 421*a* at a right spool land is not in an open condition. At this time, in accordance with the increase of displacement of the spool 421, the flow rate becomes smaller. When the instruction signal further increases, the notch 421*a* is opened, and the flow line 71 is partially communicated with the low-pressure flow passage 439 and the high-pressure flow passage 437 at the same time via the narrow areas. When the instruction signal becomes $(e_1+e_2)/2$ (FIG. 15B), the small area of communication of the notch 421*a* at the right spool land is equal to that of the notch 421*b* at the left spool land, so that the amount of flow of the fluid from the high-pressure flow passage 437 to the flow line 71 becomes equal to the amount of flow of the fluid from the flow line 71 into the low-pressure flow passage 439, and the pressure becomes ½ of the fluid pressure in the accumulator. When the instruction signal further increases to "$e_2$", the spool 421 moves right in the drawings, the notch 421*b* of at the left spool land is closed, and an end surface 421*c* of the right spool land is opened. Therefore the high-pressure fluid flows into the flow line 71. Namely, when the instruction signal is in the range of between "$e_1$" and "$e_2$", the fluid is controlled by the notches 421*a* and 421*b*, and therefore the pressure can be controlled precisely although the flow rate is small. When the signal further increases to displace the spool 421, the area of opening between the chambers 423*a* and 423*b* is increased to make the flow rate higher. When the instruction signal becomes "$e_0$", the area of opening between the chambers 423*a* and 423*b* becomes the maximum, and then the flow rate reaches the rated one. Therefore, the control of the flow rate and the control of the pressure shown in FIG. 14 can be effected.

Figure 16:
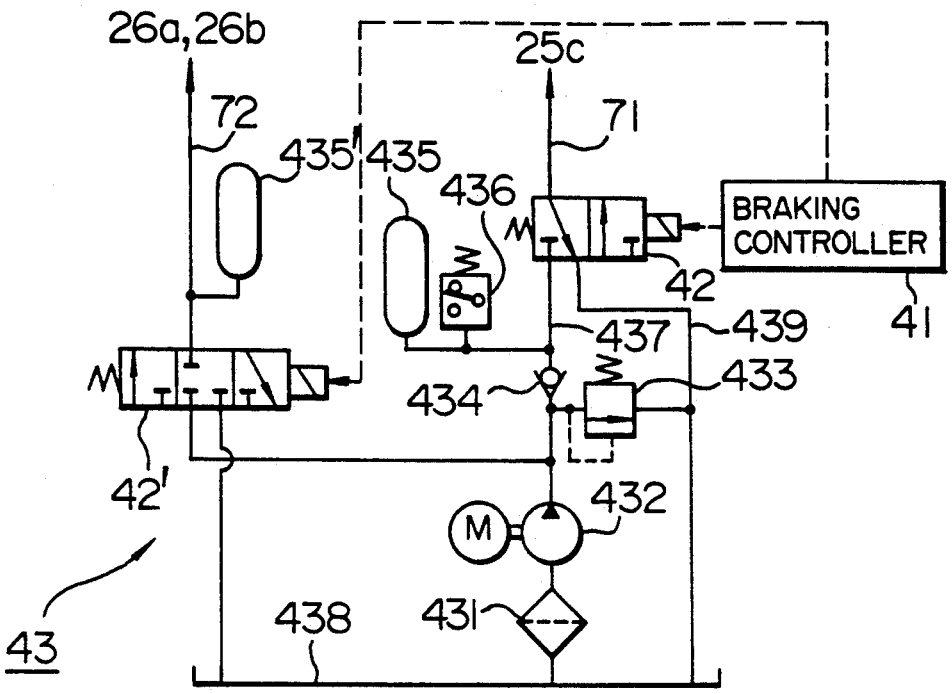
FIGS. 16 to 18 are circuit diagrams of modified hydraulic systems for driving the hydraulic cylinder used in the other embodiments of the invention.

FIG. 16 shows a pressure unit in which the hydraulic cylinder 25 and the hydraulic cylinders 26*a* and 26*b* are controlled at the same time, or the fluid pressures of the chambers 25*a*, 25*b* and 25*c* of the hydraulic cylinder 25 are controlled at the same time. The same reference numerals as those of FIG. 13 denote identical or corresponding parts, respectively. This unit is similar to the embodiment of FIG. 13 in that a fluid pumped from the pump 432 is accumulated in the accumulator 435, and that the flow rate or the pressure is controlled by a control valve 42 so as to control the displacement or the output of the hydraulic cylinder 25. The fluid pumped from the pump 432 is branched to be led to a control valve 42' which controls the high-pressure fluid to be supplied via a flow line 72 to the hydraulic cylinder 26*a* and 26*b*, or the chambers 25*a* and 25*b* of the pressure cylinder 25. In cooperation with the force of the springs 18*a* and 18*b*, the force produced by this high-pressure fluid presses the arms 215*a* and 215*b* or 1215*a* and 1215*b* toward the drum 211 or the disk 1211. An accumulator 435' is provided in the flow line 72 so that even when the hydraulic cylinder 25 or the pressure cylinders 26*a* and 26*b* are operated, the pressure in the chamber will not be varied, thereby preventing the arm pressing force from being varied. With this arrangement, in cooperation with the springs 18*a* and 18*b*, the hydraulic cylinder 25 or the cylinders 26*a* and 26*b* press the arms 215*a* and 215*b* or 1215*a* and 1215*b* against the drum 211 or the disk 1211 under a generally constant force, and by controlling the pressure of the chamber 25*c* of the hydraulic cylinder 25, the release and setting of the brake 21, the control of the braking force, and etc., can be effected rapidly and with high precision.

Figure 17:
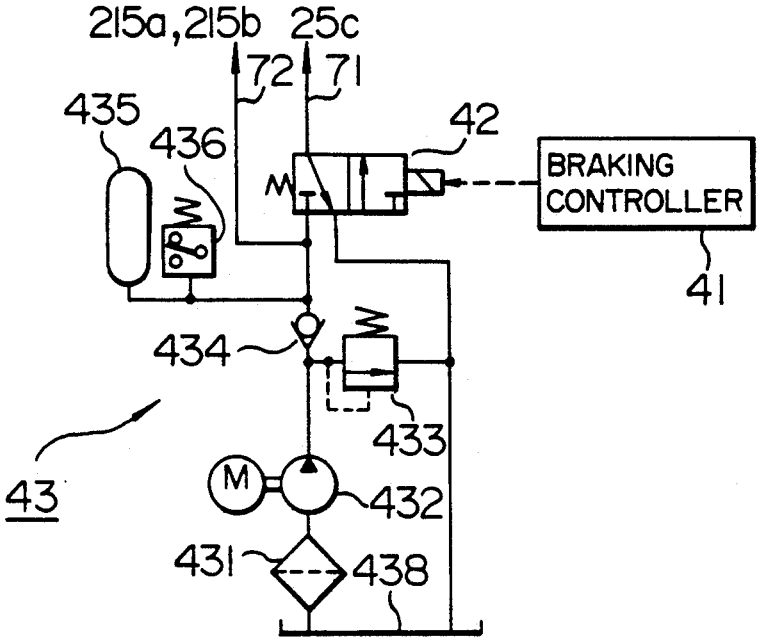

FIG. 17 shows a further modified hydraulic unit. A high-pressure fluid accumulated in the accumulator 435 is supplied to the hydraulic cylinders 26*a* and 26*b* or the chambers 25*a* and 25*b* of the hydraulic cylinder 25 so as to press the arms 215*a* and 215*b* against the drum 211 under a constant force, and the pressure of the chamber 25*c* is controlled by a control valve 42, thereby effecting the release and setting of the brake 21, the control of the braking force, and etc., rapidly and with high precision. As compared with the unit shown in FIG. 16, in this unit, the control valve 42' and the accumulator 435' are omitted to simplify the circuit. However, the operation and effects are similar to those of FIG. 16.

Figure 18:
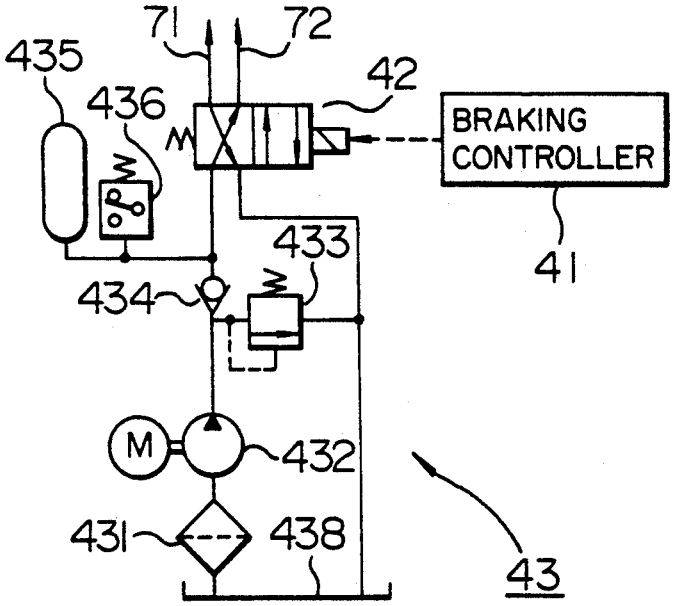

FIG. 18 shows a still further modified single hydraulic unit by which the hydraulic cylinders 25, 26*a* and 26*b*, and 125 shown in FIGS. 6 to 12 are all controlled. A fluid discharged from a hydraulic pump 432 is accumulated in an accumulator 435, and then the fluid controlled in pressure is supplied to the hydraulic cylinders 25, 26*a* and 26*b*, and 125 through the control valve 42 so as to control the output and the speed of the pressure cylinders. The hydraulic cylinder 25 controls the force for moving the arms 215*a* and 215*b*, or 1215*a* and 1215*b* away from the drum 211 or the disk 1211, and at the same time the hydraulic cylinders 26*a* and 26*b* or the hydraulic cylinder 25 control the force for pressing the arms 215*a* and 215*b*, or 1215*a* and 1215*b* against the drum 211 or the disk 1211. Therefore, when the arms are moved away from the drum (disk) through the hydraulic cylinder, the force pressing the arms against the drum (disk) by the cylinder can be decreased, and the hydraulic cylinder 25 can be of a smaller size, and therefore the hydraulic device including the pressure control valve 42 can be also of a smaller size.

According to the present invention, the brake can be controlled with a high responsibility, and its braking force can be controlled arbitrarily. Further even in the event of a power failure, the brake can be operated by the emergency power source of a small-capacity. Therefore, in the normal condition, the cage can be held accurately in its stop position, and in the event of an emergency, the optimum braking force is produced in accordance with the load and the speed of the cage, and the shortest braking distance, can be achieved with a small braking impact. Thus, the reliable and safe elevator can be obtained.

What is claimed is:

1. An elevator comprising:

a cage;

means for moving said cage upward and downward through rope means; and means for braking the movement of said cage, said braking means including a braking body connected to said moving means, a braking shoe device, a spring device for urging said braking shoe device onto said braking body with a braking force which is required to stop the downward movement of said cage under a full load condition, a fluid cylinder acting towards said braking shoe device to part it from said braking body, thereby reducing said braking force due to said spring device according to a condition of movement of said cage, and a device for controlling pressurized fluid to be supplied to said fluid cylinder as a function of said condition of movement of said cage.

2. An elevator according to claim 1, wherein said fluid cylinder acts on said braking shoe device through linkage means.

3. An elevator according to claim 2, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

4. An elevator according to claim 3, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than said middle range.

5. An elevator according to claim 1, wherein said braking shoe device includes a pair of braking shoes, and said spring device includes a pair of springs for urging the respective braking shoes onto said braking body, and said fluid cylinder acts on said braking shoes through the respective linkages.

6. An elevator according to claim 5, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

7. An elevator according to claim 6, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than said middle range.

8. An elevator according to claim 1, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

9. An elevator according to claim 8, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than said middle range.

10. An elevator comprising:

a cage;

means for moving said cage upward and downward through rope means; and means for braking the movement of said cage, said braking means including a braking body connected to said moving means, a braking shoe device, a spring device for urging said braking shoe device into said braking body with a braking force which is required to stop the upward movement of said cage under a full load condition, fluid cylinder means acting towards said braking shoe device to urge it to said braking body, thereby applying a braking force in addition to said braking force due to said spring device according to a condition of movement of said cage, and a device for controlling pressurized fluid to be supplied to said fluid cylinder means as a function of said condition of movement of said cage.

11. An elevator according to claim 10, wherein said fluid cylinder means includes a single fluid cylinder acting on said braking shoe device through linkage means.

12. An elevator according to claim 11, further comprising means for detecting at least either of a load and a speed of said cage and for outputting a signal corresponding to the detected one, and means for determining an addition which is to be added to said braking force, according to the signal from said detecting means, and wherein said control device includes a control valve which controls a flow rate and a pressure of said pressurized fluid to be supplied to said fluid cylinder, according to said addition determined by said determining means.

13. An elevator according to claim 12, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said addition is a rated one, and wherein said control valve controls the pressure of said pressurized fluid to be supplied to said fluid cylinder when said addition is in a middle range between zero and the rated one, and said control valve controls the flow rate of said pressurized fluid to be supplied to said fluid cylinder when said addition is in ranges of between zero and the rated one other than said middle range.

14. An elevator according to claim 10, wherein said braking shoe device includes a pair of braking shoes, and said spring device includes a pair of springs for urging the respective braking shoes onto said braking body, and wherein said fluid cylinder means includes a first fluid cylinder acting towards said braking shoes to urge them to said braking body through linkage means, thereby applying a braking force in addition to said braking force due to said spring device, and a second fluid cylinder acting towards said braking shoes to part them from said braking body through linkage means, thereby reducing said braking force due to said spring device.

15. An elevator according to claim 14, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

16. An elevator according to claim 15, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than said middle range.

17. An elevator according to claim 10, wherein said braking shoe device includes a pair of braking shoes, and said spring device includes a pair of springs for urging the respective braking shoes onto said braking body, and wherein said fluid cylinder means includes a single fluid cylinder acting against said braking shoes through linkage means not only to urge them to said braking body, thereby applying a braking force in addition to said braking force due to said spring device, but also to part them from said braking body, thereby reducing said braking force due to said spring device.

18. An elevator according to claim 17, wherein said single fluid cylinder includes a cylinder body and two pistons disposed within said cylinder body, each of which is provided with a piston rod connected to each of said braking shoes, and wherein said cylinder body, one of said pistons and a piston rod thereof cooperate with one another to define a first working chamber into which said pressurized fluid is supplied so as to drive said piston to urge said braking shoes onto said braking body, and wherein said cylinder body and said pistons cooperate with one another to define a second working chamber into which said pressurized fluid is supplied so as to drive said pistons to part said braking shoes from said braking body against said braking force due to said spring device.

19. An elevator according to claim 18, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

20. An elevator according to claim 19, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than said middle range.

21. An elevator according to claim 17, wherein said single fluid cylinder includes a cylinder body and two pistons disposed within said cylinder body, a piston rod of one of said pistons connected to one of said braking shoes, and a piston rod of the other one of said pistons connected to the other one of said braking shoes, and wherein said cylinder body, one of said pistons and a piston rod thereof cooperate with one another to define a first working chamber into which said pressurized fluid is supplied so as to drive said piston to urge said braking shoes onto said braking body, and wherein said cylinder body and said pistons cooperate with one another to define a second working chamber into which said pressurized fluid is supplied so as to drive said pistons to part said braking shoes from said braking body against said braking force due to said spring device.

22. An elevator according to claim 21, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

23. An elevator according to claim 22, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than said middle range.

24. An elevator according to claim 17, further comprising means for detecting at least either of a load and a speed of said cage and for outputting a signal corresponding to the detected one, and means for determining a reduction which is to be subtracted from said braking force, according to the signal from said detecting means, and wherein said control device includes a control valve which controls a flow rate and a pressure of said pressurized fluid to be supplied to said fluid cylinder, according to said reduction determined by said determining means.

25. An elevator according to claim 24, wherein said control valve includes a control port connected to said fluid cylinder, and a tank port communicated with a drain tank, and a pressure port communicated with a pressurized fluid source, and wherein said control valve connects said control port with said tank port when said reduction is zero and connects said control port with said pressure port when said reduction is a rated one, and wherein said control valve controls the pressure of said pressurized fluid to be supplied to said fluid cylinder when said reduction is in a middle range between zero and the rated one, and said control valve controls the flow rate of said pressurized fluid to be supplied to said fluid cylinder when said reduction is in ranges between zero and the rated one other than the middle range.

* * * * *